US007870823B1

(12) United States Patent
Cameron

(10) Patent No.: US 7,870,823 B1
(45) Date of Patent: Jan. 18, 2011

(54) MULTILAYER PRINT PAD

(76) Inventor: Robert Cameron, 3245 Bellwood La., Glenview, IL (US) 60026

( * ) Notice: Subject to any disclaimer, the term of this patent is extended or adjusted under 35 U.S.C. 154(b) by 40 days.

(21) Appl. No.: 12/189,347

(22) Filed: Aug. 11, 2008

(51) Int. Cl.
*B41F 17/24* (2006.01)

(52) U.S. Cl. ..... 101/41; 101/163; 101/379; 118/264

(58) Field of Classification Search ..... 101/41, 101/163, 170, 379; 118/264; 428/908; *B41F 17/34*
See application file for complete search history.

(56) References Cited

U.S. PATENT DOCUMENTS 2,748,696 A * 6/1956 Murray et al. ..... 101/41
3,701,317 A * 10/1972 Miyamoto et al. ..... 101/170
2008/0105145 A1* 5/2008 Schaafsma et al. ..... 101/41

FOREIGN PATENT DOCUMENTS

JP 63307950 A * 12/1988
JP 06316057 A * 11/1994

* cited by examiner

*Primary Examiner*—Leslie J Evanisko
(74) *Attorney, Agent, or Firm*—Robert L. Marsh

(57) ABSTRACT

A print pad for printing on a hard surface has a tip portion made of a silicon rubber having a first durometer. Rearward of the tip portion is a central body portion made of a silicon rubber having a durometer that is different than the durometer of the tip portion. Rearward of the central body is a base suitable to attachment to a machine.

3 Claims, 3 Drawing Sheets

MULTILAYER PRINT PAD

The present application relates to printing pads of the type used to print fine lines on smooth surfaces, such as those needed to print on a contact lens.

BACKGROUND OF THE INVENTION

One use for a contact lens is to change the color of one's eye. A contact lens that changes eye color has the design of the iris of the eye printed on the surface thereof. The ink that changes the eye color does not inhibit the user's visibility. The coloring in the highest quality contact lenses consists of numerous radially extending colored lines with the strands having various shades of color which combine to makeup the design of the iris. A suitable print pad must be used to apply thin lines of pigment containing inks to the smooth surfaces of a curved contact lens which minimizes the smearing the ink as it is applied or blending the ink into a previously applied coloring.

The ink that makes up the coloring may be applied directly to the outer surface of the lens after the lens has been manufactured, or may be printed into the concave inner surface of the mold used to manufacture the lens, such that when the lens is drawn from the mold, the pigment is already embedded into the outer surface thereof. Regardless of whether the ink is applied to a convex outer surface of a lens or a concave inner surface of a mold, the print pad that applied the ink must have qualities that allow the ink to be applied without smearing.

Existing print pads for applying ink to contact lenses and the like are made of a silicon rubber. The print pads have a somewhat blunted forward tip, and behind the forward tip the surface diverges in a complex curve until it reaches a generally cylindrical base. In the printing process, the print pad is first applied to a plate having etchings in the surface that are filled with ink. The ink is transferred to the surface of the print pad as the print pad is withdrawn from the plate. The print pad is next applied to the concave surface of a mold, or the convex surface of a contact lens. It is the very tip of the print pad that makes first contact with either the etched plate or the surface to which the ink is to be applied. Following the initial contact, the tip deforms as the pad is applied against the surface such that successive portions of the print pad make contact with the plate or print surface in a widening annular pattern.

In order for the print pad to apply the ink evenly to a print surface without causing smearing, the material of which the print pad is made must have a desired durometer. Even so, it has been found that the ink applied near the center of a contact lens is often smeared whereas the ink that is applied near the outer perimeter thereof is not. This is because the tip of the print pad undergoes considerably greater compression than does the more rearward portions of the print pad. The uneven forces within a print pad as it deforms limits the quality of the printed reproduction of the human iris on a contact lens. There is therefore a need to improve the quality of the print pads that apply ink to the surface of a lens or the surface of a mold used to manufacture a lens.

SUMMARY OF THE INVENTION

Briefly, the present invention is embodied in a print pad having a tip portion made of a polymer having a first durometer and a central body portion made of a polymer having a second durometer.

In another embodiment, the print pad of the invention has a tip portion made of a polymer with a first durometer, a first portion of the central body made with a polymer having a second durometer, and a second portion of the central body made with a polymer of yet a third durometer, with the various portions of the print pad being contiguous with one another and with the durometers of adjacent portions being different from one another.

To make the print pad of the present invention, a female mold is provided with the tapered end of the mold directed downwardly. A mixture of liquefied silicon resin and a hardener suitable to make a silicon rubber that will have the desired durometer of the tip portion is first introduced into the mold and allowed to harden. Thereafter, a second mixture of silicon resin and hardener is introduced into the mold where the second silicon resin and hardener are suitable to form a silicon rubber with a durometer different from the first mixture.

BRIEF DESCRIPTION OF THE DRAWINGS

A better understanding of the invention will be had after a reading of the following detailed description taken in conjunction with the drawings wherein.

DETAILED DESCRIPTION OF PREFERRED EMBODIMENTS

Figure 1:
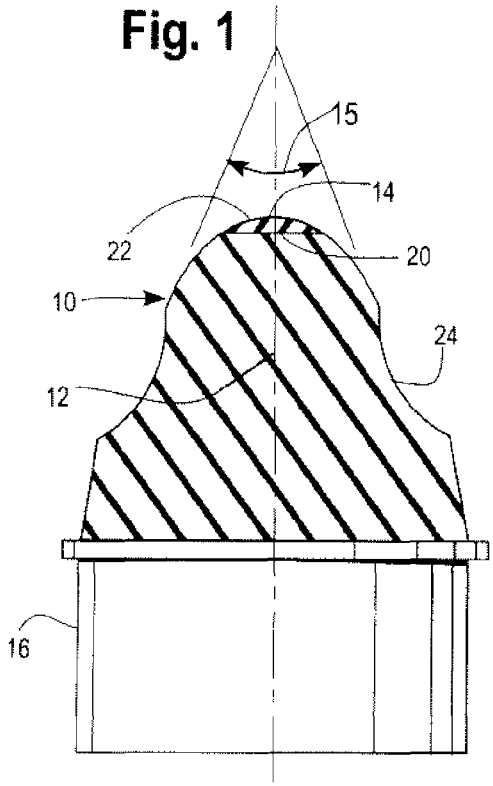
FIG. 1 is a cross-sectional view of a tip in accordance with the invention having a tip portion with a first durometer and a central body with a second durometer.

Referring to FIG. 1, a print pad 10 in accordance with a first embodiment of the present invention is depicted. The print pad 10 is symmetrical about a longitudinal axis 12. At one end of the print pad 10 is a blunted tip 14 and at the other end is a plastic or metal base 16 shaped complementary to a mounting portion of a machine, not shown. For the purpose of this discussion, the tip 14 will be considered the forward end of the print pad 10 and the base 16 will be considered at the rearward end thereof. Accordingly, behind the blunted tip portion of the tip 14 the surface of the print pad 10 diverges radially outwardly with a tangent of the surface forming an inclusive angle 15 that is largest nearest the tip 14 and is smaller as the surface moves rearwardly toward the base 16. As the surface of the print pad 10 approaches the base 16, the inclusive angle 15 approaches zero degrees and the surface of the print pad 10 immediately adjacent the base 16 is nearly cylindrical.

In accordance with the present invention, the durometer of the portion 22 of the print pad 10 that includes the tip 14 is softer than the durometer of the remaining portion 24 of the print pad 10 that includes the base 16 with the durometer undertaking a change across a plane 20 a short distance behind the tip 14. Accordingly, the print pad 10 is made of a silicon rubber having a forward portion 22 that includes the tip 14 with a first durometer and a rearward portion 24 contiguous with the first portion 22 and extending to the base 16 that is made of a silicon rubber having a second durometer that is firmer than the durometer of the forward portion 22.

Figure 2:
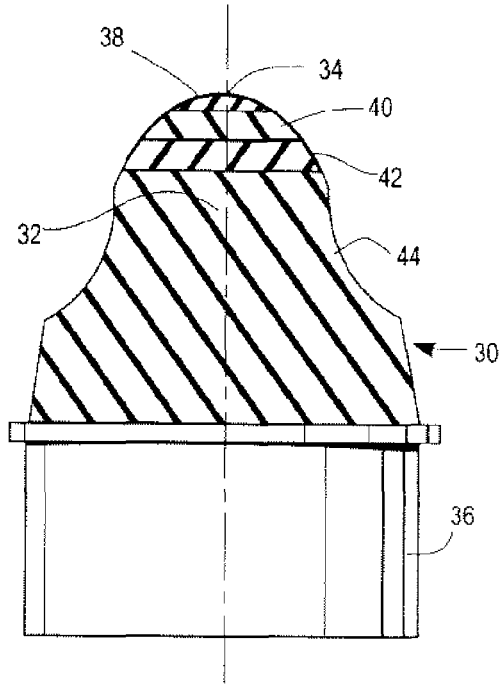
FIG. 2 is a cross-sectional view of another tip in accordance with the invention in which the tip portion has a first durometer, and behind the tip section is a first portion of the central body having a durometer different from the tip section, behind the first portion is a second portion of the central body having a durometer different from the first portion, and a third portion of the central body is behind the second, the third portion having a durometer different from the second portion of the central body.

Referring to FIG. 2, in yet another embodiment, a print pad 30 is symmetrical about a longitudinal axis 32 at one end of which is a tip 34 and the other end is a base 36. In this embodiment, the print pad 30 has a forward portion 38 that includes the tip 34 made of a silicon rubber with a first durometer. Rearward of the forward portion 38 is a first midsection portion 40 having a durometer different than the durometer of the forward portion 38. Rearward of the first midsection portion 40 is a second midsection portion 42 having a durometer different from the first midsection portion 40. Behind the second midsection portion 42 is a third midsection portion 44 having a durometer that is different from the durometer of the second midsection portions. In this embodiment, the third midsection 44 is positioned immediately forward of the base 36.

It should be appreciated that although each successive portion 38, 40, 42, 44 of the print pad 30 is deformed in succession, that it may not always be desirable that the durometer of the successive portions be firmer than the prior section. The firmness of the respective sections 38, 40, 42, 44 is determined by the contour of the curved surface against which the print pad is applied so as to minimize the smearing of ink.

Figure 3:
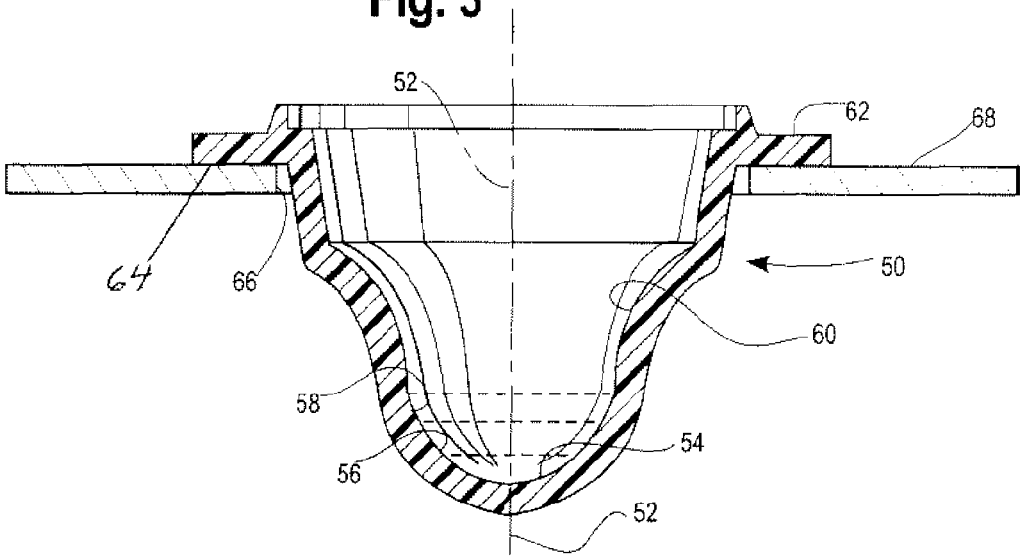
FIG. 3 is a cross-sectional view of a mold used to manufacture a tip in accordance with the print pad shown in FIG. 2.

Referring to FIG. 3, a print pad having multiple layers of differing durometer, such as the print pad 30 described above, is formed in a female mold 50 that is preferably made in accordance with my previously issued U.S. Pat. No. 6,979,419 B2 which is incorporated herein by reference. The female mold 50 is symmetric around a longitudinal axis 52 and has a lower end 54 complementary to the shape of the tip 34. Above the lower end 54 is a first midsection 56, the outer surface of which has a shape complementary to the first midsection portion 40 of tip 30, and above the first midsection 56 is a second midsection 58, the inner surface of which is complementary to the outer surface of the second midsection portion 42. Above the second midsection 58 is a third midsection 60, the inner surface of which is complementary to the third midsection portion 44. The mold 50 has a planar upper annular surface 62, and below the upper surface 62 is an annular lower surface 64 for retaining the mold 50 in a hole 66 of a retaining plate 68.

To make the print pad 30, a silicon rubber and hardener suitable for forming the rubber with the desired durometer for the tip section 34 of print pad 30 is poured into the mold 50 and allowed to harden. Thereafter, silicon resin and hardener suitable for forming a rubber with a durometer of the first midsection portion 40 is poured into the mold 50 and allowed to harden. Thereafter, silicon resin and hardener suitable for forming the second midsection portion 42 is poured into the mold 50 and allowed to harden. A preformed plastic base 36 is positioned at the upper end of the mold 50 and the silicon resin and hardener suitable for forming the third midsection portion 44 is poured into the mold 50 and base 36 and allowed to harden. After all the sections 38, 40, 42, 44 have hardened, the formed print pad 30 can be removed from the mold 50.

The silicon resin and hardener suitable for forming a print pad in accordance with the invention can be acquired from any of several known manufacturers of the chemicals needed to form such silicon rubber, one of the manufacturers being Dow Corning. The durometer of the various sections can be changed by adding a diluent, such as oil, to the mixture of the silicon resin and the hardener. By increasing the percentage of oil in the mixture of silicon resin and hardener, the durometer of the silicon resin formed becomes progressively softer. By adjusting the oil content of the various portions 38, 40, 42, 44 of the print pad 30, a print pad can be made that deforms at a rate that will minimize the smearing effect that occurs as the print pad applied ink to a hard surface such a contact lens.

Figure 4:
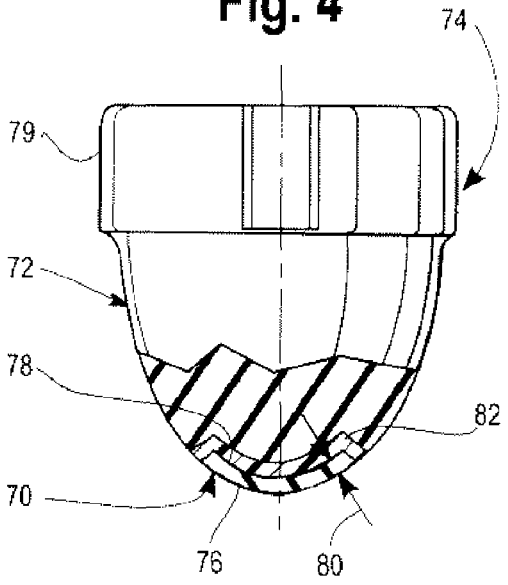
FIG. 4 is a cross-sectional view of another print pad made in accordance with the invention.

Referring to FIG. 4 another print pad 74 in accordance with the invention is depicted having portions 70, 72 thereof that are not configured into planar layers. The I portions of a print pad may be in any of a number of configurations chosen to provide the desired compressive qualities to the print pad 74. In this embodiment, the print pad 74 has a relatively hard tip portion 70 having a generally convex or semi-spherical outer surface 76 that forms the surface of the tip and a non-planar inner surface 78. In this embodiment, the inner surface 78 is depicted as being generally concave, with the two surfaces 76, 78 spaced a fixed distance 80 from one another. Rearwardly of the hard tip portion 70 and extending from the base 79 into the concave inner surface 78 is a softer second portion 72.

Referring further to FIG. 4, I have found that the diluent in the rubber of a first portion 70 of a print pad 74 will gradually seep into the rubber of an adjacent second portion 72 causing the durometer of the two portions 70, 72 to blend together and generally equalize. To inhibit this tendency of a diluent to blend, I have provided a relatively thin blocking layer 82 of undiluted silicon rubber between the first and second portions 70, 72.

Figure 5:
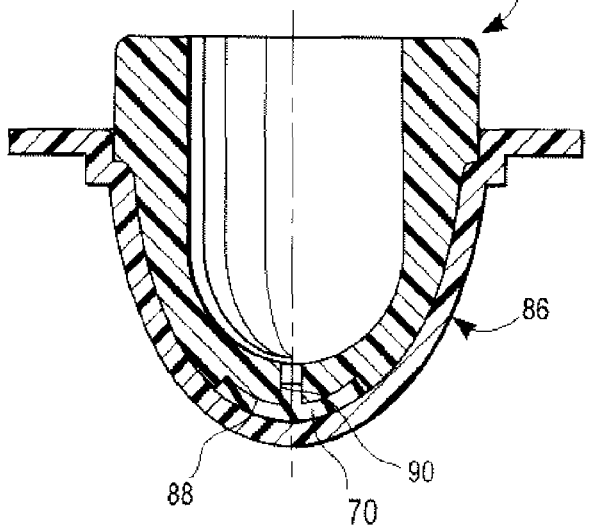
FIG. 5 is a cross-sectional view of a female and first male mold needed to form the tip section of the print pad shown in FIG. 4.
Figure 6:
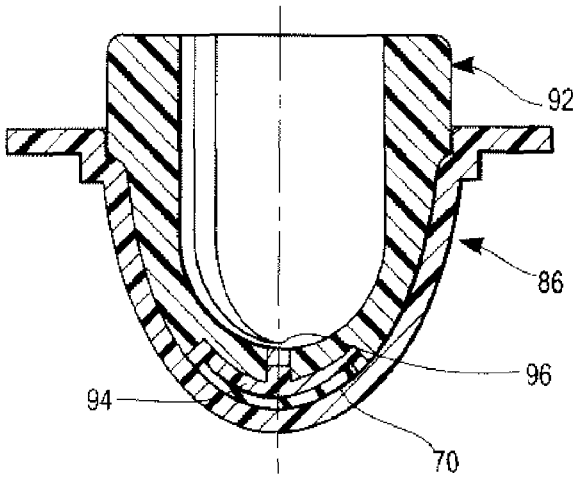
FIG. 6 is a cross-sectional view of the female mold shown in FIG. 5 and a second male mold needed to form the print pad shown in FIG. 4.

Referring to FIGS. 5 and 6, the concave inner surface 78 of the first portion 70 of print pad 74 is formed by inserting a male mold 84 into the cavity of a female mold 86 having an inner surface in the shape of the print pad 74, the male mold 84 having with a recess 88 at the tip thereof. This recess 88 includes a surface that is complementary in shape to the concave surface 78 of the first portion 70 of the print pad 74. The mixture of silicon resin, hardener, and diluent required to form the first portion 70 is inserted into the recess 88 through an axial hole 90 in the male mold 84. Excess rubber left in the hole 90 can be cut away and removed after the rubber hardens and the mold 84 is removed.

A male mold 92 that is somewhat similar to male mold 84 but having a somewhat larger recess 94 is used to form the blocking layer 82 that surrounds the upper surface and sides of the first portion 70 and separates the tip portion 70 from the second portion 72. The second male mold 92 is inserted into the female mold 86 after the tip portion 70 has been formed and the first male mold 84 is removed. The resin and hardener, without any diluent, is poured through a hole 96 in the mold 92 until it fills the cavity between the recess 94 and the tip portion 70. After the resin and hardener needed to form the blocking layer 82 harden the second male mold 92 is removed. Thereafter a mixture of resin, hardener and diluent suitable for forming the second portion 72 of the print pad 74 is added to the female mold 86 and allowed to harden. After all the components 70, 72, 82 have hardened the formed print pad 74 is removed from the mold 86.

Figure 7:
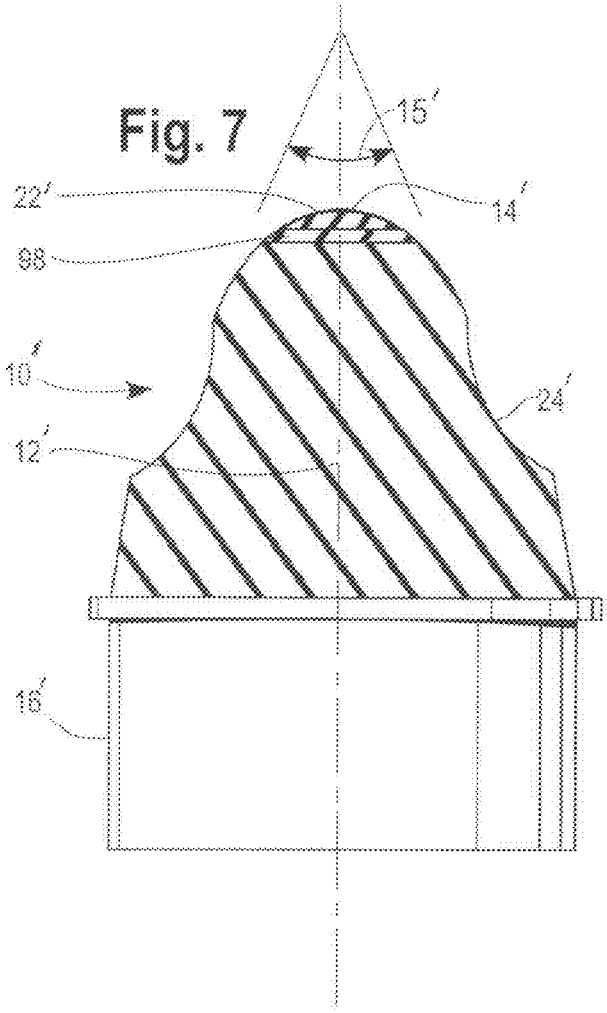
FIG. 7 is a cross-sectional view of another embodiment of a print pad in accordance with the invention.

Referring to FIG. 7, a print pad 10' is disclosed that is substantially the same as print pad 10 described above. The portions of print pad 10' that are identical to the portions of print pad 10 bear identical indicia numbers except that they are primed. In this regard, the print pad 10' has a longitudinal axis 12', a tip 14', a base 16' with tangents to the various surfaces forming an inclusive angle 15'. Print pad 10' has a tip portion 22' having a first durometer and a first percentage of a diluent and a second portion 24' having a second durometer and a second percentage of diluent. Between the first and second portions 22', 24' is a thin blocking layer of silicon rubber 98 that contains no diluent. The blocking layer 98 prevents the diluent from one portion 22', 24' of print pad 10' bleeding into the other portion 22', 24'. Similar blocking layers can be formed to separate the layers 38, 40, 42, 44 of the print pad 30 that is also described above.

Figure 8:
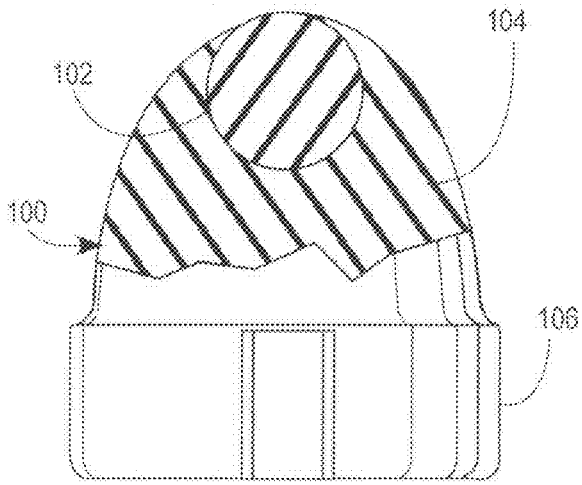
FIG. 8 is a cross-sectional view of a print pad in accordance with yet another embodiment of the invention.

Referring to FIG. 8 in which yet another embodiment of a print pad 100 in accordance with the invention is depicted. Print pad 100 includes a generally spherical first portion 102 with the sphere 102 forming the blunted forward end of the first pad 100. Surrounding most of the spherical first portion 102 is a second portion 104 that extends rearwardly and is received in a base 106 for attachment to a machine, not shown. In this embodiment, the first spherical portion 102 has a durometer that is different from the durometer of the second portion 104. Depending on the qualities required, the first portion 102 may be harder or softer than the second portion 104.

While the present invention has been described with respect to several embodiments, it will be appreciated that many modification and variations may be made without departing from the spirit and scope of the invention. It is therefore the intent of the appended claims to cover all such modifications and variations that fall within the true spirit and scope of the invention.

What is claimed:

1. A print pad comprising a tip portion made of a first polymer having a first durometer and having a first percentage of diluent, a central body made of a second polymer having a second durometer and a second percentage of diluent, said central body being rearward of said tip portion, said first durometer different from said second durometer and said first percentage different from said second percentage, a blocking layer of polymer between said tip portion and said central body, said blocking layer of polymer being formed without a diluent so as to form a barrier between said tip portion and said central body, and a base behind said central body portion wherein said base is for retaining said print pad to a machine.

2. The print pad of claim 1 wherein said tip portion has a semi-spherical outer surface and a non-planar inner surface.

3. A print pad comprising a tip portion made of a first polymer having a first percentage of a diluent, a central body made of a second polymer having a second percentage of a diluent different from said first percentage, and a blocking layer between said first polymer and said second polymer, said blocking layer formed without a diluent.

* * * * *